US005078613A

United States Patent [19]

Salmon

[11] Patent Number: 5,078,613

[45] Date of Patent: Jan. 7, 1992

[54] SYSTEM FOR GROUNDING TELECOMMUNICATIONS CABLE RACK ASSEMBLY AND THE LIKE

[75] Inventor: Garland R. Salmon, Durham, N.C.

[73] Assignee: Newton Instrument Company, Butner, N.C.

[21] Appl. No.: 540,896

[22] Filed: Jun. 20, 1990

[51] Int. Cl.[5] ..... H01R 4/66

[52] U.S. Cl. ..... 439/92; 29/866; 174/94 S; 439/95

[58] Field of Search ..... 439/92, 95, 100, 115, 439/210, 431, 433, 434, 444; 174/84 S, 94 R, 6; 29/866

[56] References Cited

U.S. PATENT DOCUMENTS

| | | | |
|---|---|---|---|
| 852,691 | 5/1907 | Adams . | |
| 1,259,000 | 3/1918 | Dodd . | |
| 2,250,280 | 7/1941 | Starbird | 173/324 |
| 2,580,321 | 12/1951 | Rees | 173/324 |
| 2,999,124 | 9/1961 | Burke | 174/84 |
| 3,451,033 | 6/1969 | Flachbarth | 339/14 |
| 3,601,748 | 8/1971 | Hart et al. | 439/115 |
| 4,659,870 | 4/1987 | Jones | 174/84 |

FOREIGN PATENT DOCUMENTS

| | | | |
|---|---|---|---|
| 1036963 | 7/1966 | United Kingdom | 439/210 |

*Primary Examiner*—Eugene F. Desmond
*Attorney, Agent, or Firm*—Richard E. Jenkins

[57] ABSTRACT

A system for grounding telecommunications cable rack assemblies and the like. The system comprises the positioning of an electrical conductor element beneath each end of at least one of the U-shaped clamp elements of a clamping junction between adjacent cable rack sections. The conductor elements comprise means for piercing the non-electrically conductive painted surface of the adjacent cable rack sections and forming electrical continuity therebetween through the clamping junction when the U-shaped clamp elements thereof are tightened on the adjacent cable rack sections.

9 Claims, 4 Drawing Sheets

SYSTEM FOR GROUNDING TELECOMMUNICATIONS CABLE RACK ASSEMBLY AND THE LIKE

TECHNICAL FIELD

This invention relates to a system particularly suited for grounding telecommunications equipment, such as a cable rack assembly for supporting electrical cable, and more particularly to an improved grounding system for a telecommunications cable rack assembly which obviates the need for conventional grounding wire and associated lugs and bolts for securing the wire to the cable rack sections.

BACKGROUND ART

As is known to those familiar with the telecommunications art, cable rack is formed in sections of various lengths and assembled into cable rack assemblies for use to support large quantities of cable such as found in telephone switching offices and large computer installations. As is also well known, all equipment in facilities such as telephone switching offices and large computer installations must be grounded to prevent damage to sensitive electrical equipment which could occur if static and other electrical charges are not continually allowed to bleed off to ground.

Although cable rack sections and the clamping junctions used to connect the cable rack sections into large cable rack assemblies are metal, the cable rack sections are typically painted on the surface thereof which would normally serve to insulate the individual cable rack sections from each other and prevent proper grounding of the cable rack assembly. Therefore, the cable rack assemblies must be specially adapted to create electrical continuity between individual cable rack sections in order to allow static and other electrical charges to properly bleed off to ground to minimize risk to sensitive electrical equipment associated with cable rack assemblies.

Heretofore, it has been the practice to extend copper or other suitable wire between individual cable rack sections in order to assure electrical continuity therebetween. It has been a common practice to drill and tap individual cable rack sections so that suitable wire can be extended therebetween and secured thereto with lugs and bolts. Specifically, the process entails drilling and tapping each individual cable rack section, cutting wire (such as 3/16 inch No. 6 copper wire) to desired lengths, stripping the insulation from the ends of the wire lengths and attaching lugs thereto, and then attaching the wire links to the cable rack sections by bolting the lugs to the drilled and tapped holes therein. This grounding procedure for cable rack assemblies is very expensive since it requires labor intensive utilization of highly skilled workers and the utilization of expensive materials such as copper wire and associated lugs and bolts for connecting the wire to cable rack sections. Moreover, the drilling and tapping procedure required to attach the grounding wire to cable rack sections produces metal chips and shavings which pose a damage of contamination to sensitive electrical equipment associated with the cable rack assembly and therefore requires a careful and time consuming clean-up after installation of the grounding wire to the cable rack sections.

For these and other reasons well known to those skilled in the art, there has long been a need for an improved system for grounding cable rack assemblies.

DISCLOSURE OF THE INVENTION

In accordance with the present invention, applicant provides an improved system for grounding telecommunications cable rack assemblies and the like. The system of the invention provides for placing an electrical conductor element beneath each end of at least one of the U-shaped clamp elements which form the electrically conductive clamping junctions for connecting adjacent ends of metal cable rack sections. The conductor elements are elongate L-shaped metal clips having a planar base portion with an upturned end to facilitate positioning of the electrical conductor element. The base portion defines at least one aperture therein having a flared edge extending outwardly from the base portion and adapted to pierce the non-electrically conductive paint on the surface of a cable rack section. Thus, when the U-shaped clamp elements of clamping junctions are tightened together on adjacent cable rack sections so as to form a rigid connection therebetween, the electrical connector elements positioned beneath the opposing ends of at least one U-shaped clamp element of each clamping junction serve to create a continuous electrical connection between adjacent rack sections through the clamping junction therebetween by piercing the paint on adjacent cable section ends. This provides electrical contact between the adjacent cable section ends and the clamping junction therebetween.

It is therefore an object of the invention to provide a simple and reliable system for grounding a cable rack assembly.

It is also an object of the invention to provide a system for grounding cable rack assemblies with substantially reduced labor and material cost. It is another object of the invention to provide a grounding system for cable rack assemblies which provides ease of installation and does not require drilling and tapping of cable rack sections and the associated cleanup thereafter.

It is yet another object of the invention to provide a grounding system for cable rack assemblies which is more aesthetically pleasing and does not occupy usable space as does conventional grounding wires.

It is a still further object of the invention to provide a grounding system for cable rack assemblies which eliminates the exposed grounding wires and thereby obviates damage caused by tangling of electrical cables carried by the cable rack assembly with the grounding wires thereof.

Some of the objects and advantages of the invention having been stated, others will become evident as the description proceeds, when taken in connection with the accompanying drawings.

BEST MODE FOR CARRYING OUT THE INVENTION

Figure 1:
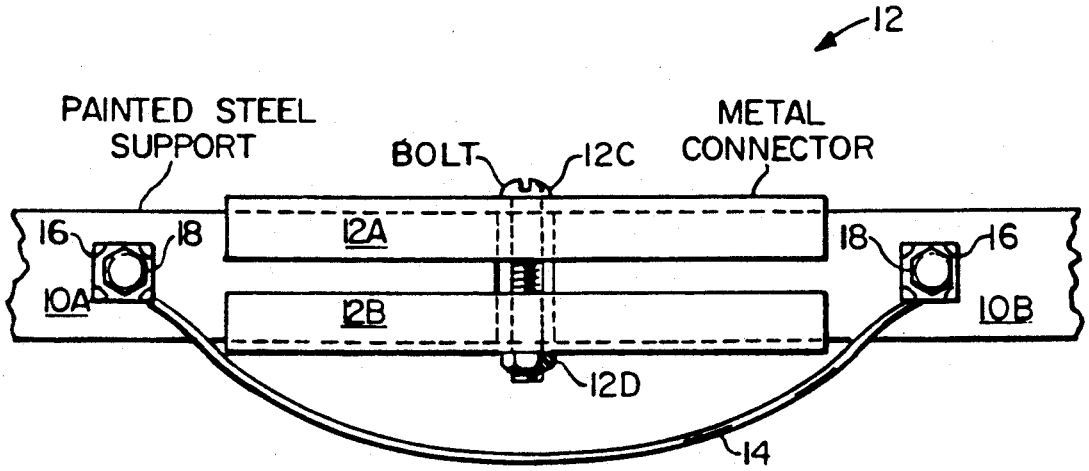
PRIOR ART FIG. 1
FIG. 1 is a side elevational view of a prior art grounding connection between two adjacent cable rack sections.
Figure 2:
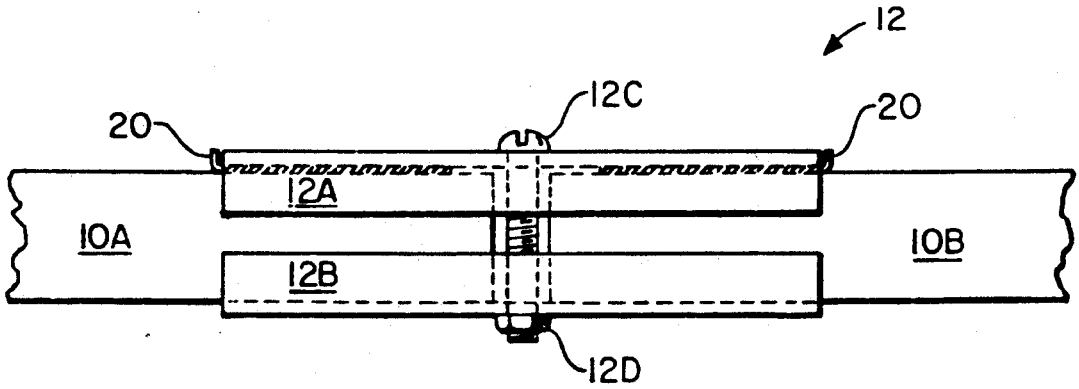
FIG. 2 is a side elevational view of the grounding system of the invention used to ground two adjacent cable rack sections.
Figure 3A:
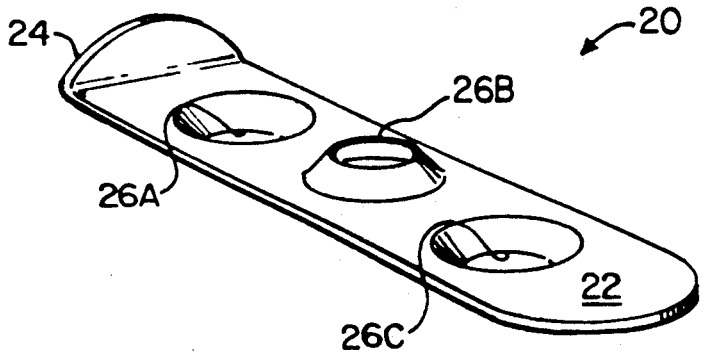
FIGS. 3A-3D are perspective, side elevational, front elevational, and top plan, respectively, views of a first embodiment of the electrical conductor element used in the system of the invention.
Figure 3B:
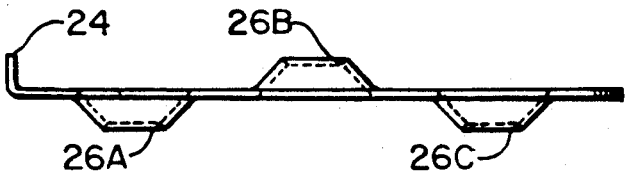
Figure 3C:
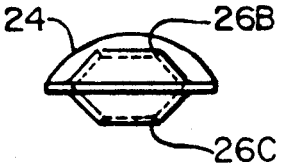
Figure 3D:
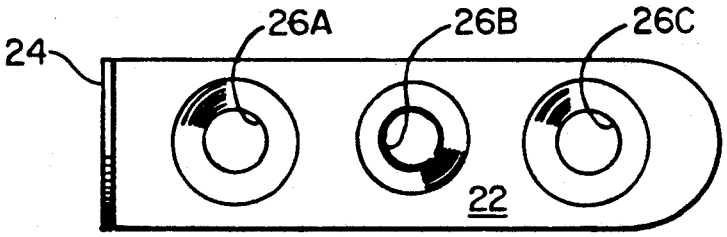
Figure 4A:
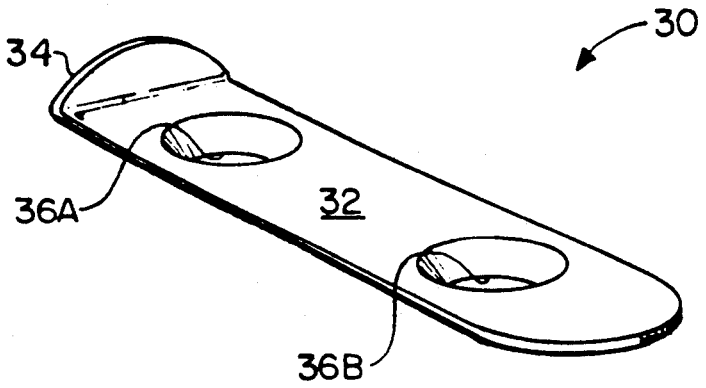
FIGS. 4A-4D are perspective, side elevational, front elevational, and top plan views, respectively, of a second embodiment of the electrical conductor element used in the grounding system of the invention.
Figure 4B:
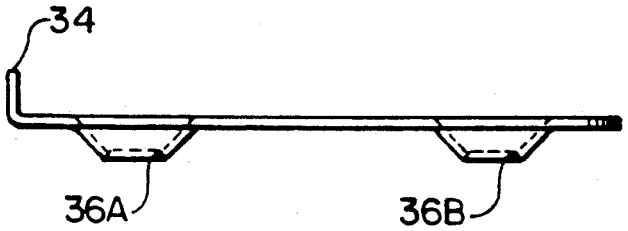
Figure 4C:
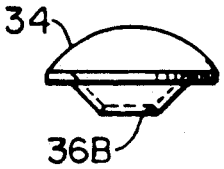
Figure 4D:
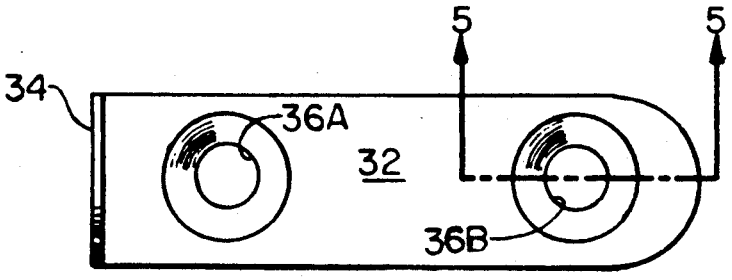

Referring now more specifically to the drawings, FIG. 1 shows a cable rack assembly grounded in accordance with the prior art and FIG. 2 shows a cable rack assembly grounded according to the present invention. Also, although the present application specifically describes "cable racks" herein, it should be appreciated that "cable rack" is also intended to include cable tray, cable trough, cable ladder, ladder rack and the like which are familiar to one skilled in the art.

In FIGS. 1 and 2, reference numerals 10A, 10B indicate adjacent cable rack sections and reference numeral 12 broadly indicates a clamping junction comprising upper and lower U-shaped clamps, 12A, 12B, and bolt 12C extending therebetween and secured by nut 12D. Although cable rack sections 10A, 10B are shown as connected by clamping junction 12 so as to extend lengthwise, it should be appreciated that the invention contemplates a new system for providing a continuous ground through any configuration of adjacent cable rack sections including but not limited to lengthwise and right angle connections (not shown) and other connections made between adjacent cable rack sections in order to form a cable rack assembly to support electrical cable for such applications as telephone switching offices and large computer installations.

With reference again to FIG. 1, it can be seen that cable rack sections 10A, 10B are rigidly connected by clamping junction 12. Since cable rack sections 10A, 10B are typically painted on the surface thereof, metal clamping junction 12 does not serve to provide an electrical connection between the adjacent cable rack sections. Thus, in accordance with present practice, a wire 14 (typically a 3/16 inch No. 6 copper wire or the like) is fitted with lugs 16 at each end thereof and then attached to cable rack sections 10A, 10B with bolts 18 which are threaded into corresponding holes (not shown) which have been drilled and tapped into the cable rack sections. In this fashion, electrical continuity is provided since the paint on the surface of cable rack sections 10A, 10B has been penetrated by the drilled and tapped holes and an electrical connection provided therebetween through bolts 18, lugs 16, and wire 14 extending therebetween. As noted above, however, the cost of this conventional technique is very substantial in view of the labor and material costs of wiring an entire cable rack assembly in this fashion in order to provide for electrical continuity throughout and proper grounding of the entire cable rack assembly.

Figure 5:
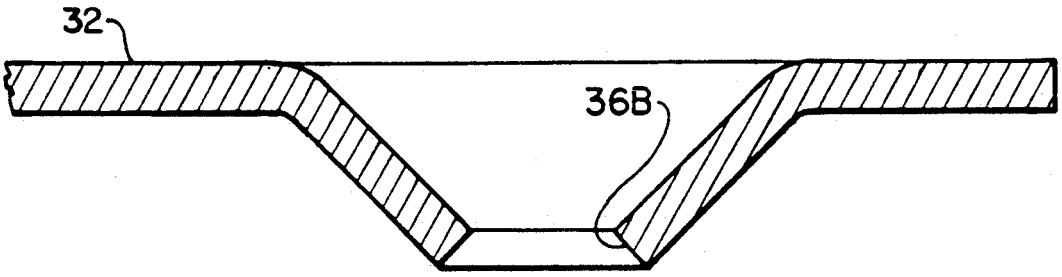
FIG. 5 is a transverse sectional view taken along line 5—5 of FIG. 4.

By contrast, FIG. 2 shows applicant's inventive system whereby the conventional bolts 18, lugs 16 and wire 14 used to extend between cable rack sections 10A, 10B have been replaced by electrical conductor elements 20. As can be appreciated with reference to the drawing, electrical conductor elements 20 are merely inserted adjacent each end of one or both U-shaped clamps 12A, 12B so as to be sandwiched between the U-shaped clamp and cable rack sections 10A, 10B. Electrical conductor elements 20 each include means for piercing the paint on the surface of cable rack sections 10A, 10B when compressed by tightening of clamping junction 12 and thereby to form electrical continuity between cable rack sections 10A, 10B through both electrical conductor means 20 and clamping junction 12 extending between the cable sections. The fashion in which electrical conductor elements 20 act to achieve this function can be best understood with reference now to FIG. 3-5 of the drawings.

FIG. 3 represents a first embodiment of the electrical conductor element 20 and comprises a base portion 22 and an upturned end portion 24 to provide for ease of insertion of conductor element 20 under the opposing ends of one or both U-shaped clamp elements 12A, 12B of clamping junction 12. Base portion 22 of electrical conductor element 20 defines 3 apertures therein, 26A-26C, wherein apertures 26A, 26C have a flared or frusto-conical ridge therearound which extends downwardly from base portion 22 and aperture 26B has a flared or frusto-conical ridge therearound which extends upwardly from the base portion. The flared ridges of apertures 26A, 26C serve to cut through the paint of a cable rack section therebeneath when inserted beneath the end of a clamping junction and the clamping junction is tightened so as to force the flared ridges of apertures 26A, 26C into the cable rack section therebeneath and thus to form an electrical connection between the cable rack section and the clamping junction. The optional upwardly extending flared ridge of aperture 26B serves to form a better electrical connection between electrical conductor element 20 and clamping junction 12.

A second embodiment 30 of the electrical conductor element is shown in FIGS. 4A-4D of the drawings. Conductor element 30 comprises base portion 32 and upturned end 34. Base portion 32 defines two apertures therein 36A, 36B which each have a flared ridge extending downwardly therefrom so as to provide a cutting surface for piercing the paint of a cable rack section when forced thereagainst by tightening of a clamping junction 12 thereon. Although two embodiments, 20 and 30, of the electrical conductor element are shown in the drawings as well as representative measurements of an aperture of the second embodiment in FIG. 5 (which are also representative of a typical aperture in first embodiment 20), applicant wishes to emphasize that other configurations and dimensions thereof are contemplated as being within the scope of the invention. By way of example, apertures 26A-26C and 36A, 36B may include any suitable outwardly extending cutting edge in lieu of the flared ridges described herein.

With specific reference now to electrical conductor elements 20 and 30, applicant contemplates that they preferably are formed of spring steel that is hardened and treated with a zinc and gold chromate finish after manufacture. The zinc and gold chromate finish provides a noncorrosive coating for the steel of conductor elements 20 and 30 but tends to be non-conductive. However, the flared ridges of the apertures of conductor elements 20 and 30 are formed so as to be sufficiently sharp that the force thereon when compressed by clamping junctions 12 is sufficient to both pierce the paint of an associated cable rack section as well as chip the chromate finish away from where the edge of each flared ridge enters the paint and metal of the cable rack section to form a good electrical connection. Although the zinc and gold chromate finish is desirable, electrical conductor elements 20 and 30 may be fabricated from hardened spring steel or other suitable metal and not provided with a noncorrosive coating of zinc and gold chromate or the like.

In operation, a cable rack assembly may be grounded in accordance with the present invention by inserting an electrical conductor element 20 under each end of one or both of the U-shaped clamps which form clamping junction 12 between adjacent ends of cable rack section 10A, 10B. Thereafter, clamping junction 12 is tightened by means of bolt 12C in order to urge U-shaped clamps 12A and 12B together. This serves to rigidly connect the cable rack sections as well as to force the flared ridges of apertures 26A, 26C of conductor element 20 adjacent each end of clamping junction 12 into electrical contact with a respective cable rack section. In this fashion, electrical continuity is provided between painted cable rack section 10A to painted cable rack section 10B through clamping junction 12, and the need to span the junction with a copper wire in accordance with conventional practice is obviated. Finally, applicant wishes to observe that the electrical conductor elements 20 may be used in accordance with the present invention either at the time of construction of a cable rack assembly in order to assure proper electrical continuity and grounding thereof or may be simply retrofit into a cable rack assembly already installed by merely loosening each clamping junction 12 and inserting conductor elements 20 under each end of one or both U-shaped clamps 12A, 12B and then tightening the clamping junction.

It will thus be seen that there is provided, as described hereinbefore, a simple and reliable system for grounding a cable rack assembly which provides unexpected and surprising ease of installation as well as significant labor and material cost savings.

It will be understood that various details of the invention may be changed without departing from the scope of the invention. Furthermore, the foregoing description is for the purpose of illustration only, and not for the purpose of limitation—the invention being defined by the claims.

What is claimed is:

1. A method of grounding telecommunications cable rack comprising:

providing at least two metal cable rack sections in adjacent relationship, said cable rack sections being coated with a non-electrically conductive material on at least a portion of the surface thereof;

connecting said cable rack sections with one or more electrically conductive clamping junctions of the type comprising upper and lower clamp elements having securement means extending therebetween for urging said clamp elements together and into contact with said adjacent cable rack sections;

positioning an electrical conductor element beneath each end of at least one of said clamp elements prior to tightening of said clamp elements together on said adjacent cable rack sections, said conductor elements comprising means for piercing the non-electrically conductive material on the surface of said cable rack sections;

tightening said clamp elements together on said adjacent cable rack sections so as to cause said electrical conductor elements positioned between said clamp elements and said adjacent cable rack sections to pierce the non-electrically conductive material on the surface of each of said cable rack sections and thereby to form a continuous electrical connection therebetween.

2. A telecommunications cable rack assembly comprising:

a plurality of metal cable rack sections, said cable rack sections being coated with a non-electrically conductive material on at least a portion of the surface thereof;

a plurality of electrical conductor clamping junctions connecting the ends of adjacent cable rack sections, said clamping junctions each comprising upper and lower clamp elements with securement means for urging said clamp elements together and into contact with the ends of said adjacent cable rack sections; and a plurality of electrical conductor elements wherein an electrical conductor element is positioned beneath each end of at least one of said clamp elements of said plurality of clamping junctions, said conductor elements each comprising means for piercing the non-electrically conductive material on the surface of a respective one of said adjacent cable rack sections;

whereby a continuous electrical connection is formed between said plurality of cable rack sections to facilitate grounding thereof.

3. A telecommunications cable rack assembly according to claim 2 wherein said cable rack sections are coated with paint.

4. A telecommunications cable rack assembly according to claim 2 wherein said clamp elements connect the spaced-apart ends of said adjacent cable rack sections and said securement means comprises a bolt extending between said clamps.

5. A telecommunications cable rack assembly according to claim 2 wherein said conductor elements comprise an elongate L-shaped metal clip having a planar base portion and an upturned end, said base portion defining at least one aperture therein having a flared edge extending outwardly from said base portion.

6. A telecommunications cable rack assembly according to claim 5 wherein said conductor element is spring steel with a substantially non-electrically conductive zinc and gold chromate noncorrosive coating which is adapted to be pierced when said clamp elements are connected to said cable rack sections.

7. A telecommunications cable rack assembly according to claim 5 wherein said conductor elements comprise two spaced-apart apertures along the length of said conductor element with the flared edges thereof extending downwardly from said base portion.

8. A telecommunications cable rack assembly according to claim 5 wherein said conductor elements comprise three spaced-apart apertures along the length of said conductor element with the flared edges of two apertures extending downwardly from said base portion and the flared edge of the third aperture extending upwardly from said base portion.

9. A conductor element for use in grounding telecommunications cable rack assemblies by placement beneath the opposite ends of clamping junctions connecting adjacent cable rack sections, said conductor element comprising an elongate L-shaped metal clip having a planar base portion and an upturned end, said base portion defining three spaced apart apertures having flared edges and positioned along the length of said base portion with the flared edges of two apertures extending downwardly from said base portion and the flared edge of the third aperture extending upwardly from said base portion.

* * * * *